US005117793A

United States Patent [19]

Taue et al.

[11] Patent Number: 5,117,793

[45] Date of Patent: Jun. 2, 1992

[54] HIGH PRESSURE FUEL INJECTION UNIT

[75] Inventors: Jun Taue; Hidenori Suhara, both of Iwata, Japan

[73] Assignee: Yamaha Hatsudoki Kabushiki Kaisha, Iwata, Japan

[21] Appl. No.: 656,244

[22] Filed: Feb. 15, 1991

[30] Foreign Application Priority Data

Feb. 15, 1990 [JP] Japan ..... 2-34880

[51] Int. Cl.[5] ..... F02D 41/04

[52] U.S. Cl. ..... 123/436

[58] Field of Search ..... 123/419, 436

[56] References Cited

U.S. PATENT DOCUMENTS 4,495,920 1/1985 Matsumura et al. ..... 123/436
4,575,800 3/1986 Kittelson ..... 123/436 X
4,616,617 10/1986 Geiger et al. ..... 123/436
4,697,561 10/1987 Citron ..... 123/436 X
4,883,038 11/1989 Nakaniwa ..... 123/436
4,930,479 6/1990 Osawa et al. ..... 123/436
4,932,379 6/1990 Tang et al. ..... 123/436
4,977,508 12/1990 Tanaka et al. ..... 123/436 X

FOREIGN PATENT DOCUMENTS 0176424 10/1983 Japan ..... 123/436

*Primary Examiner*—Willis R. Wolfe
*Attorney, Agent, or Firm*—Ernest A. Beutler

[57] ABSTRACT

A fuel injection system and method for a fuel injected engine of the multi cylinder type for minimizing variations in crankshaft speed due to variations in individual cylinder to cylinder firing. These variations are compensated for by changing the fuel injection and specifically the duration of the fuel injection. The engine speed is measured for each cylinder either by the time required to reach top dead center from a predetermined angle, the time to reach bottom dead center from a predetermined angle, or from the average speed.

40 Claims, 8 Drawing Sheets

HIGH PRESSURE FUEL INJECTION UNIT

BACKGROUND OF THE INVENTION

This invention relates to a high pressure fuel injection unit and more particularly to a system and method for operating a multi cylinder fuel injected engine that minimizes variations in cylinder to cylinder speed.

It is well known that cylinder to cylinder performance variations can cause several difficulties in conjunction with internal combustion engines. That is, if the speed at which the engine rotates when successive cylinders are fired varies, then noise and vibration can result. Previously, such cylinder to cylinder variations have been accommodated only through a mechanical adjustment which must be made and then left in place. However, the cylinder to cylinder performance can vary during the life of the engine and in response to other variable features than life.

It is, therefore, a principal object of this invention to provide an improved arrangement and structure for minimizing cylinder to cylinder speed variations in a multiple cylinder engine.

It is a further object of this invention to provide a method and structure for minimizing vibrations and noise in a multi cylinder fuel injected engine.

It is a yet further object of this invention to provide an improved system and method for operating a fuel injected engine to minimize speed variations from cylinder to cylinder.

SUMMARY OF THE INVENTION

A first feature of this invention is adapted to be embodied in a fuel injection system for a multi cylinder engine that comprises fuel injection means for delivering fuel to the cylinders of the engine. Means are provided for measuring the rotational speed of the engine in timed relationship to the firing of each of the cylinders. Means adjust the fuel injection means to minimize variations in engine speed due to cylinder to cylinder variations.

Another feature of the invention is adapted to be embodied in a method for operating a fuel injected multi cylinder engine that has fuel injection means for delivering fuel to the cylinders of the engine. The method comprises the steps of measuring the rotational speed of the engine in timed sequences so as to sense the speed of the engine driven by each cylinder. The fuel injection is then adjusted to minimize cylinder to cylinder variations.

DETAILED DESCRIPTION OF THE PREFERRED EMBODIMENTS

Figure 1:
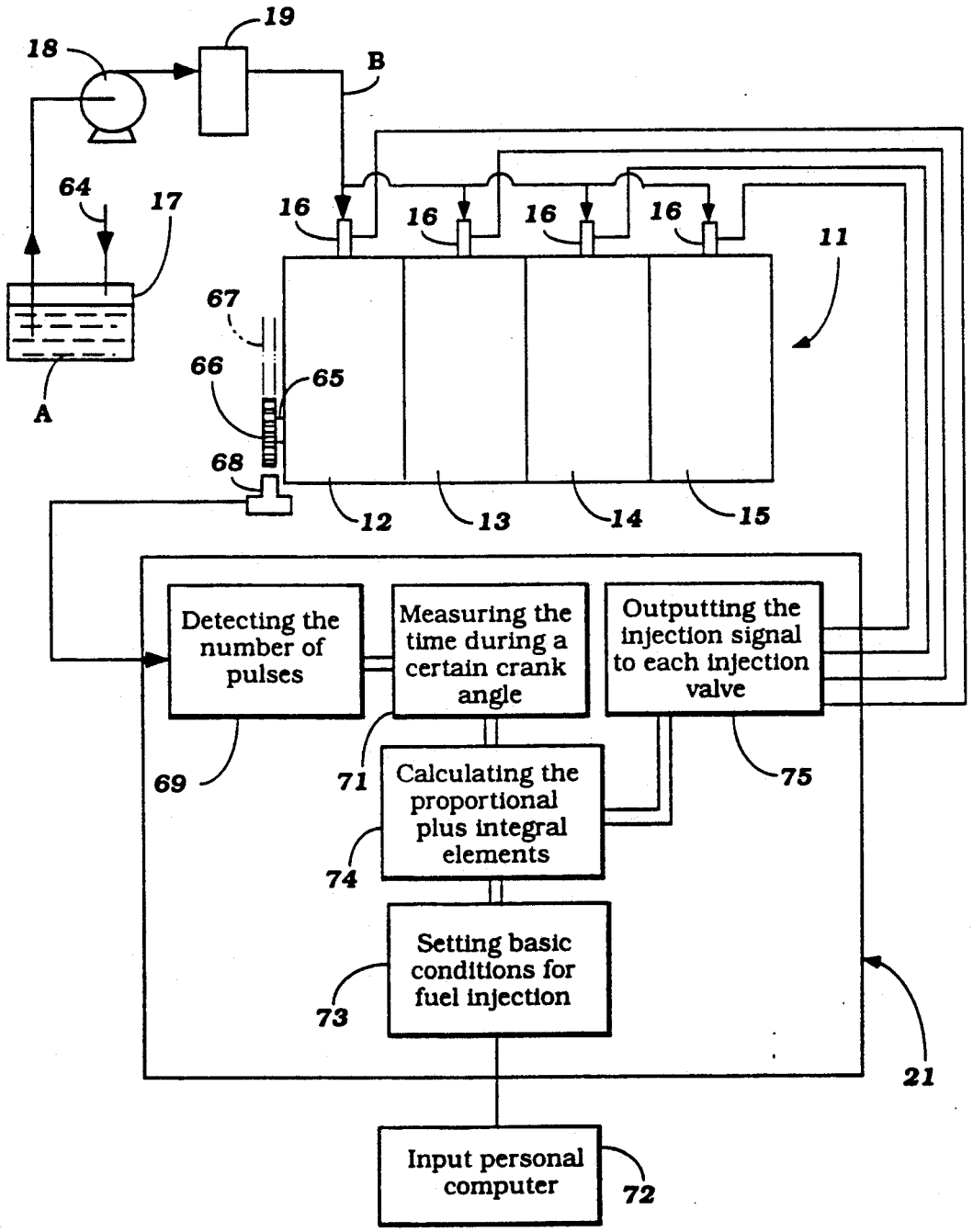
FIG. 1 is a partially schematic view of a four cylinder fuel injected, diesel engine operating in accordance with the method of the invention and incorporating a fuel injection system incorporating the invention.

Referring first to FIG. 1, a multi cylinder internal combustion engine constructed in accordance with an embodiment of the invention is identified generally by the reference numeral 11 and is shown partially in schematic form. In the illustrated embodiment, the engine 11 is a four cylinder, in line reciprocating engine operating on the diesel four stroke principle and has cylinders indicated schematically at 12, 13, 14 and 15. Since the invention deals with the fuel injection and the method for control thereof, the internal details of the structure of the engine have not been illustrated since they are not necessary to understand how the invention operates. Also, although the invention is described in conjunction with a four cylinder, four cycle, diesel engine, it should be readily apparent to those skilled in the art that the invention can be practiced with a wide variety of other engine types.

Each of the cylinders 12 through 15 is provided with a perspective fuel injector 16 having a construction as will be described by reference to FIGS. 2 through 4, which is supplied with fuel from a fuel tank 17 under pressure from a high pressure fuel pump 18 which delivers the fuel to a pressure regulator 19. The pressure is regulated by returning the fuel to the tank 17 in a known manner.

The injectors 16 are, in the illustrated embodiment, of the accumulator type that are controlled by electrically operated solenoids. These solenoids are controlled by a control circuit, indicated generally by the reference numeral 21 and which will be described in more detail later.

Figure 2:
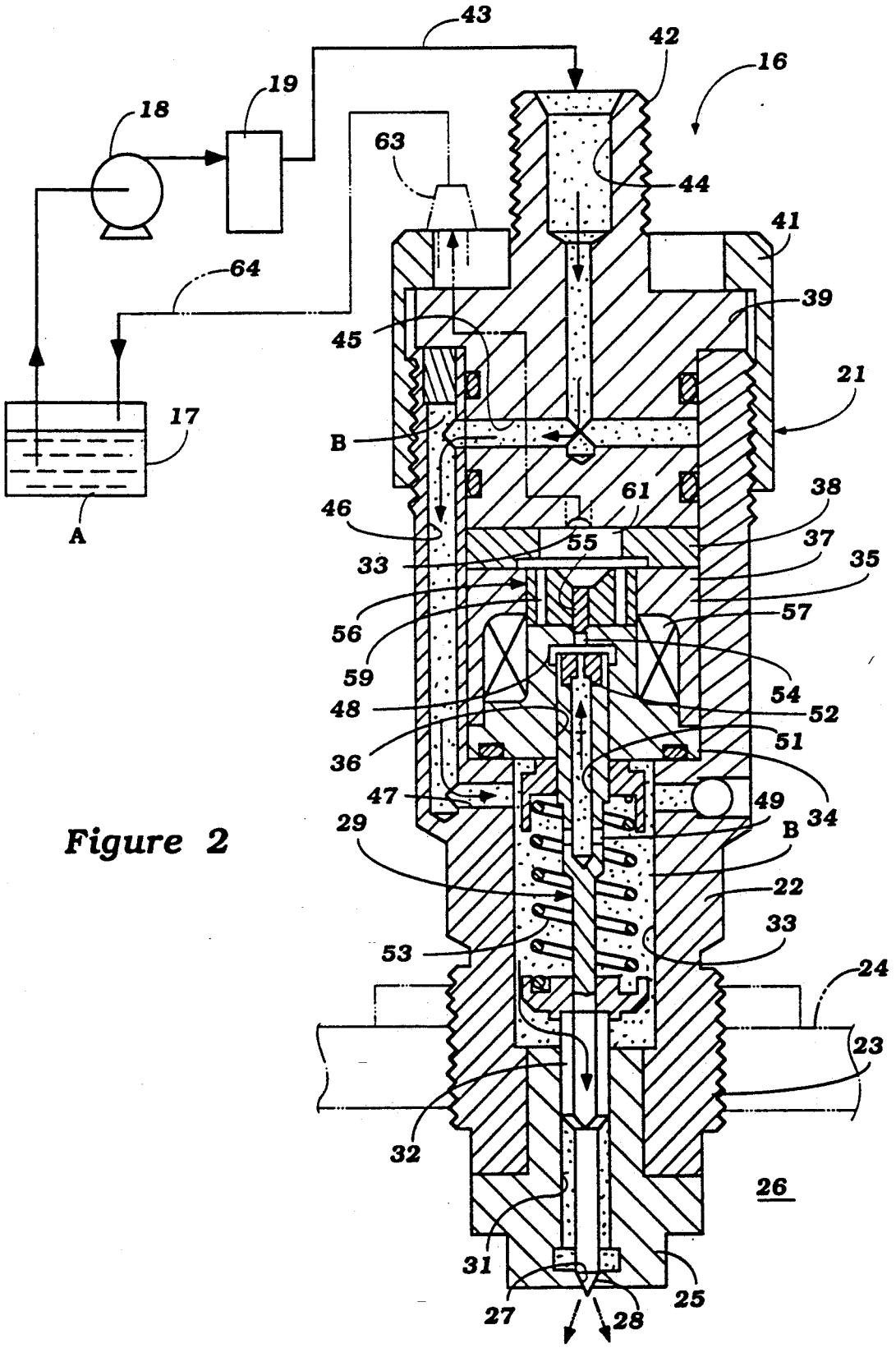
FIG. 2 is an enlarged cross sectional view taken through one of the fuel injectors and showing the fuel injector with the fuel supply system in schematic form.
Figure 3:
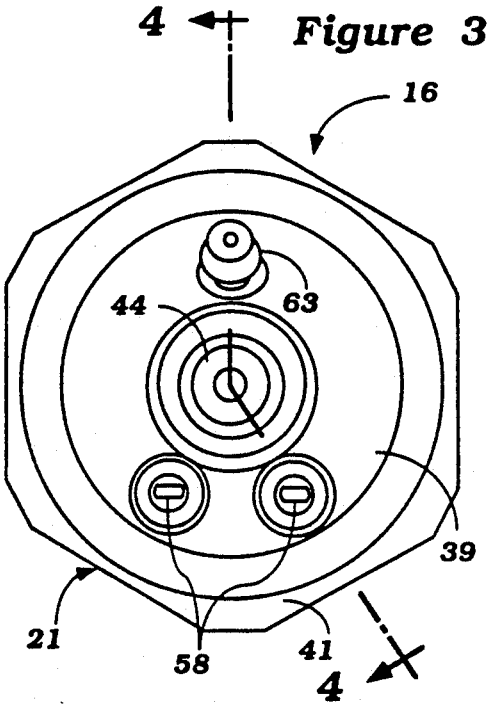
FIG. 3 is a top plan view of the fuel injector.
Figure 4:
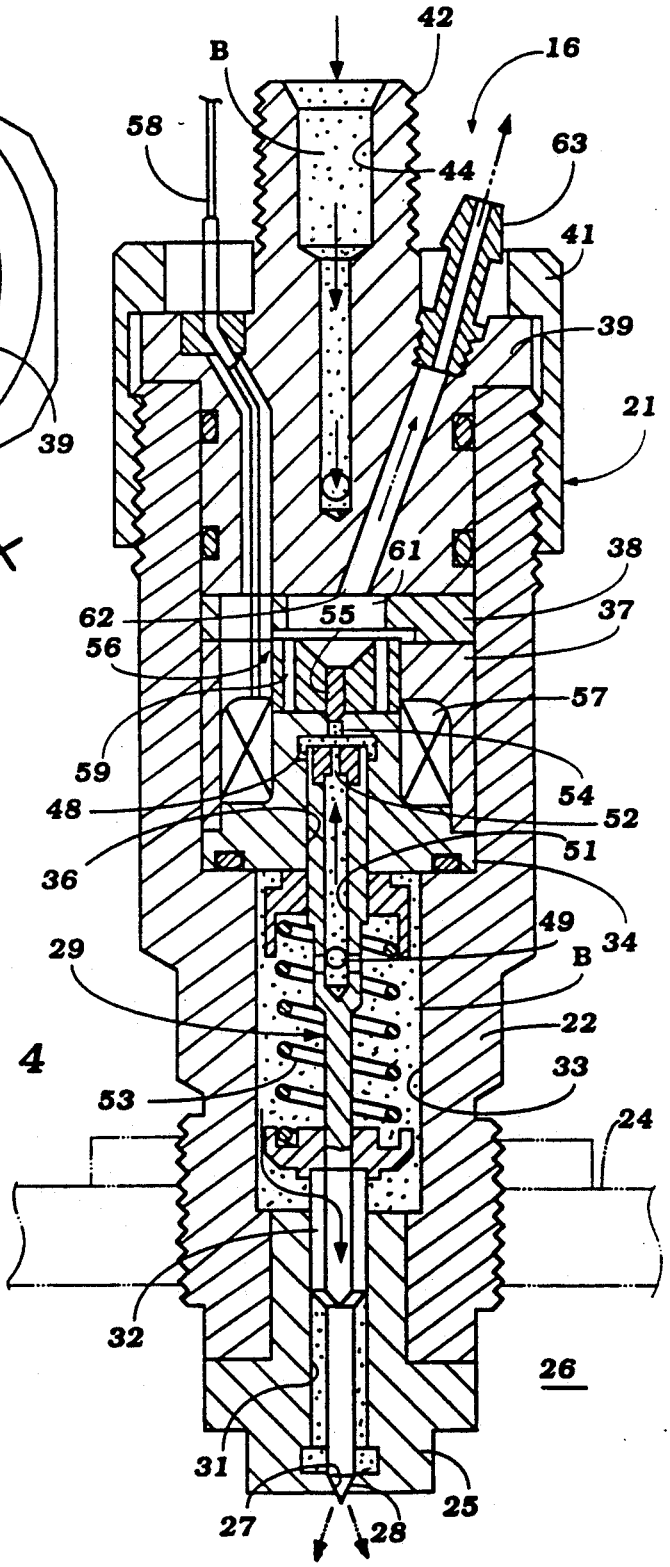
FIG. 4 is a cross sectional view taken along the line 4—4 of FIG. 3.

Referring now to FIGS. 2 through 4, the construction and operation of the fuel injectors 16 will be described. Each fuel injector 16 has a main housing assembly 21 that is comprised of a main housing piece 22 that has a threaded lower end 23 that is adapted to be threadably received in a cylinder head 24 of the engine 11. A nozzle tip 25 is threaded into the main housing portion 22 and extends into the combustion chamber 26 of the respective cylinder. The nozzle tip 25 is formed with an injection nozzle port 27 with the flow through this port 27 being controlled by the valve portion 28 of an injection valve, indicated generally by the reference numeral 29. The valve portion 28 is supported within a bore 31 by means of an enlarged flattened section 32 of the nozzle tip 25 so as to permit flow of fuel from an accumulator chamber 33 formed in the main housing part 22. A combined closure plate and solenoid core 34 is positioned within a counter bore 35 formed at the upper end of the accumulator chamber 33 and closes the accumulator chamber. A bore 36 is formed in the plate 34 and an enlarged diameter portion of the injector valve 29 is slidably supported therein.

A yoke 37 is received above the closure plate 34 and is held in engagement with the closure plate 34 by means of a ring 38. The ring 38 is held in position by an end plug 39 which, in turn, is held in place by a cap 41 that has a threaded connection to the main housing piece 22.

The end cap 39 is formed with a fitting portion 42 that receives a high pressure line 43 for communicating fuel under pressure to an inlet port 44. The inlet port 44 is intersected by means of a cross drilled passageway 45 which communicates with a vertically extending passageway 46 formed in the main housing piece 22 and which terminates at a further drilled passageway 47 that communicates the high pressure fuel with the accumulator chamber 33.

A control chamber 48 is formed in the plate 34 at the upper end of the bore 36. High pressure fuel is delivered to the control chamber 48 from the accumulator chamber 33 through a drilled passageway 49 formed in the injector valve 29 which intersects an axially extending passageway 51. A metering orifice 52 is provided at the upper end of the passageway 51 and admits high pressure fuel to the control chamber 48. When the control chamber 48 is under pressure, the pressure acting on the enlarged portion of the injector valve 49 will cause a pressure difference on the injector valve 49 so as to hold it in the closed position as shown in the figures. A coil compression spring 53 may also be provided so as to assist in holding the injector valve 29 in its closed position and also so as to hold the injector valve 29 closed when the system is not under pressure.

In order to achieve the discharge of fuel, the pressure in the control chamber 49 is reduced. For this purpose, there is provided a valve port 54 that extends through the upper end of the control chamber 48 and which is controlled by means of a valve element 55 that is slidably supported in a valve body 56. A solenoid winding 57 encircles the core portion of the closure plate 34 and is energized by means of a pair of electrical terminals 58 that extend through the upper portion of the end cap 39 and which are energized by the control circuit (FIG. 1) in a manner to be described. When the solenoid winding 57 is energized, the valve 55 will be held in its closed position, the control chamber 48 will be energized and the injector valve will be held closed. However, when the energization of the winding 57 is terminated, the fuel pressure acting in the control chamber 48 will urge the control valve 45 to its open position. When this occurs, fluid may leak out of the control chamber 48 through drilled passageways 59 formed in the valve body 56 and into a return chamber 61 formed in the washer 38. This fuel is then returned through a passage 62 formed in the end plate 39 to a fitting 63. The fitting 63 communicates with a return line 64 for delivering the fuel back to the fuel tank 17.

Hence, it will be understood that the fuel injector 16 operates so that when the solenoid winding 57 is energized, no fuel will be discharged. However, when the winding 57 is deenergized, the control chamber 48 will be dumped back to the tank 17 and the injector valve 29 will be open so that fuel can spray from the nozzle port 27.

When the engine 11 is shut off, the solenoid winding 57 will be deenergized and the valve element 55 can move open so as to relieve the pressure in the accumulator chamber 33. However, the spring 53 will continue to hold the injection valve 29 in its closed position so that no fuel will leak into the combustion chambers of the engine.

Referring now again to FIG. 1, the control system for controlling the delivery of fuel from the fuel injection nozzle 16 will be described. This system relies upon an arrangement for sensing both the angular position of the crankshaft or engine output shaft as well as the engine speed. The crankshaft is identified at the reference numeral 65 and has affixed to it a drive gear 66 which may, for example, drive a chain 67 for driving one or more overhead mounted camshafts (not shown). A sensor 68 is juxtaposed to the drive gear 66 and will generate a pulse each time a tooth of the drive gear 66 passes it. If 360 teeth are employed, then there will be a pulse generated by the sensor 68 for each degree of crankshaft revolution. Of course, other arrangements may be employed depending upon the number of teeth and so on which may be used.

The control unit 21 includes a device 69 which receives the input from the sensor 68 and counts the number of pulses that are generated. This output is transmitted to a device 71 which includes a timer and which thus measures the number of pulses generated in a predetermined time, or alternatively, the time required for the crankshaft to rotate through a given angle. The particular time interval measured will be described later in accordance with one of the various possible control routines. The system further includes an input personal computer 72 which derives a program for setting the desired injection period $\theta$ for a given speed of rotation of the crankshaft 65 and the basic time for injection of the engine depending on various running condition parameters such as temperature, throttle opening, etc. This inputs into a memory unit 73 the basic conditions for fuel injection. In addition, the engine speed signals from the time measuring device 71 are inputted to a program calculating unit 74 which calculates the desired fuel injection signal and outputs this to a control unit 75 which, in turn, controls the solenoids 57 of the individual fuel injectors 16 for each cylinder in accordance with a program now to be described.

Figure 5:
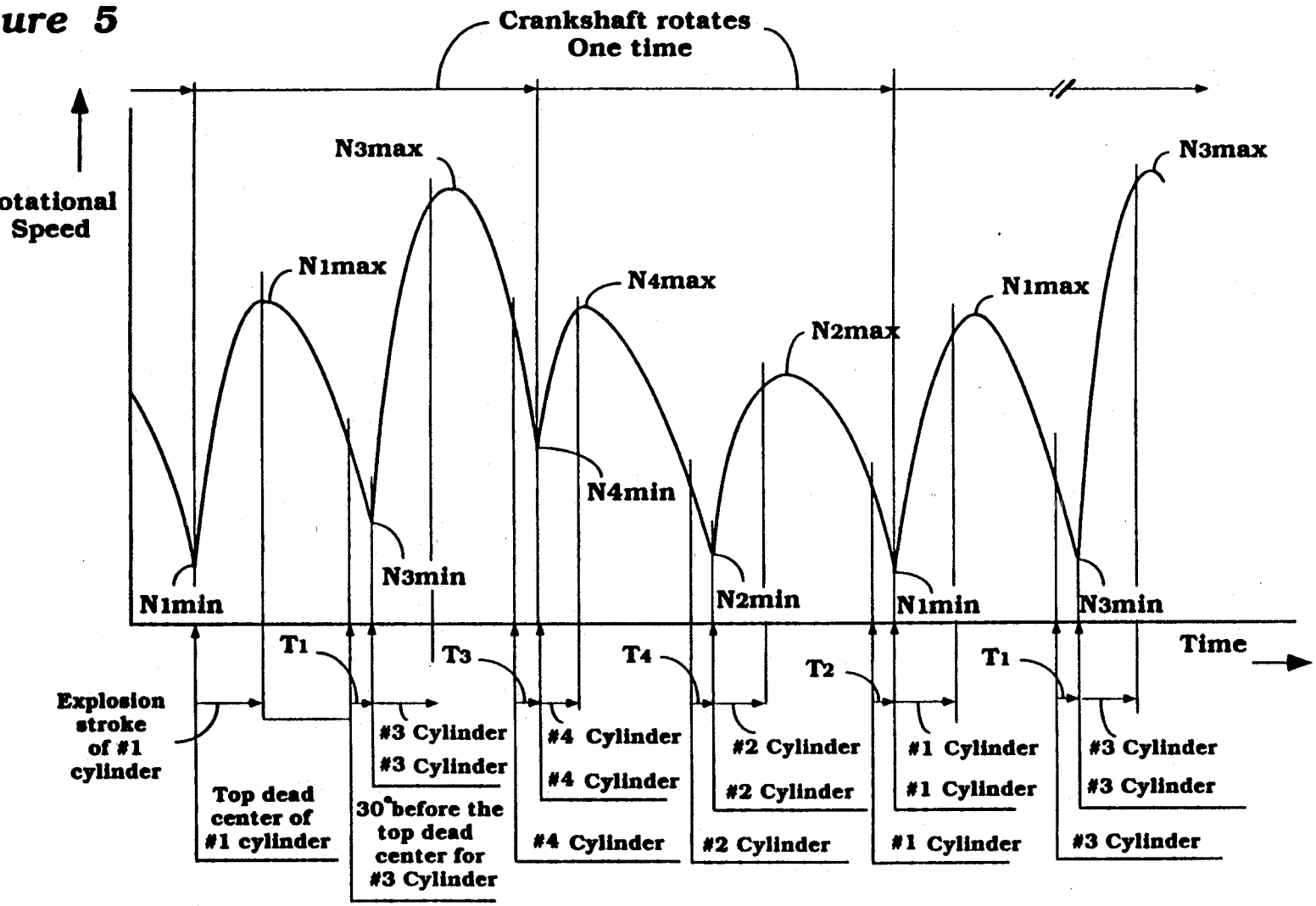
FIG. 5 is a graphic view showing the speed variations during successive crankshaft revolutions as caused by cylinder to cylinder variations.

The principle of the invention may be best understood first by reference to FIG. 5 which is a trace showing the variations in crankshaft speed during several successive rotations of the crankshaft. The curve is for a four cylinder, four cycle, diesel engine, as aforenoted, and operates on the firing order 1, 4, 3, 2. Similar curves would be generated obviously with other firing orders. The characteristics of all engines is such that the crankshaft speed is normally at the minimum when the cylinder next to be fired is at top dead center and is at the maximum some time after combustion has begun. Hence, it will be seen at the beginning top dead center of the position of cylinder number 1, the crankshaft velocity N1 is at a minimum and as cylinder number 1 expands and reaches its maximum speed N1max until the expansion completes. The speed then falls off and reaches a minimum speed N3min at bottom dead center of the next firing cylinder, cylinder number 3. Crankshaft speed then reaches its maximum N3max after the expansion in cylinder 3 and continues on as shown in this figure. It can be seen from the figure that the speed of the crankshaft varies during the rotation due to different combustion characteristics in each cylinder which can occur for a wide variety of reasons. Basically, the principle of the invention is to measure the speed variations during each cylinder's firing phase and then to make an adjustment in the fuel injection for that cylinder so as to try to minimize the cylinder to cylinder variations. In accordance with the first described control routine, the time interval at which the speed is measured is the time that it takes the crankshaft to rotate from a position 30° before top dead center to top dead center for that cylinder. As will be described later, other variations and operational principles are possible within the invention. This method thus minimizes minimum speed variations from cylinder to cylinder.

Figure 6:
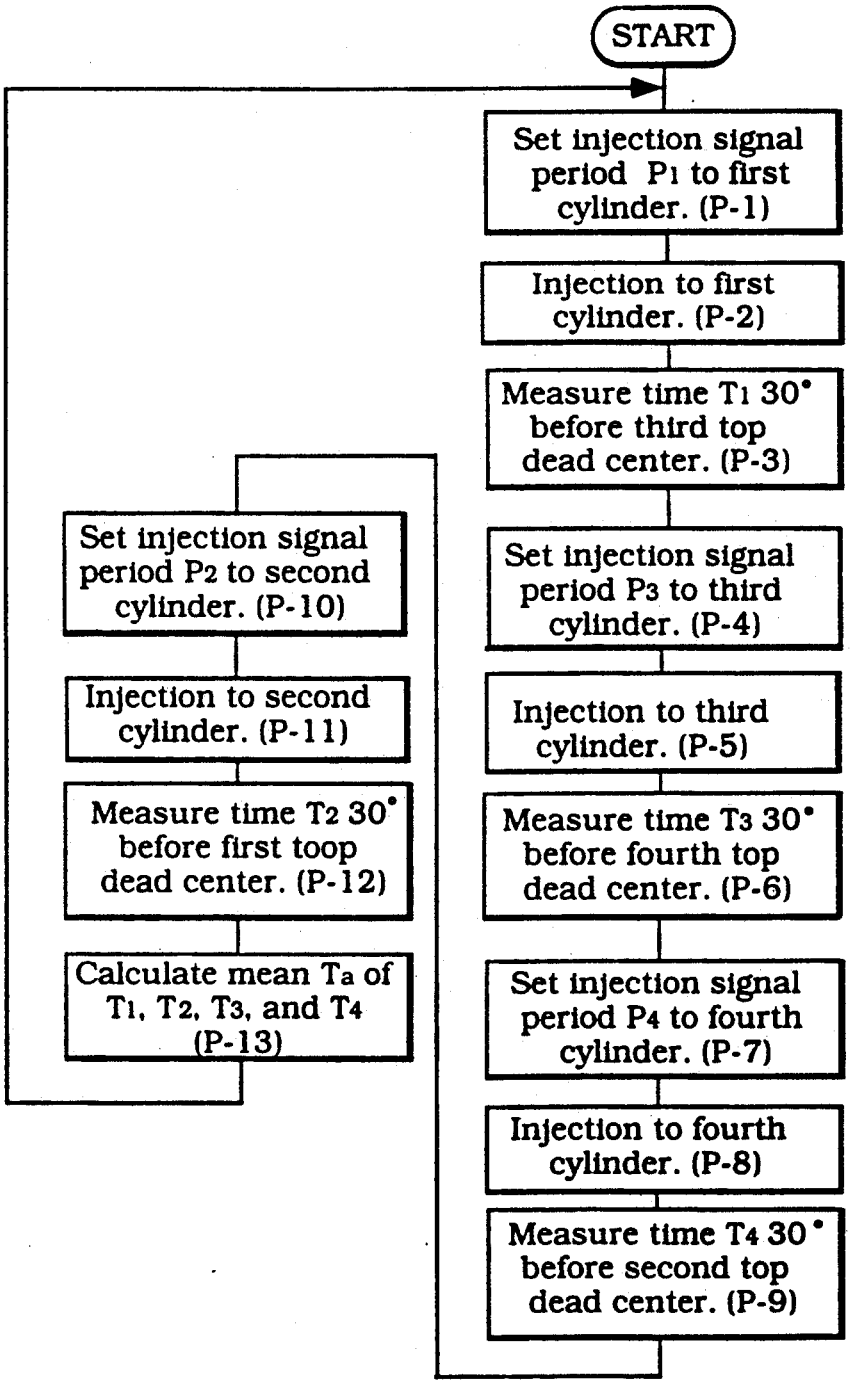
FIG. 6 is a block diagram showing the control routine in accordance with the invention.

Referring now to FIG. 6, a portion of the control routine in accordance with this feature will be described. The program starts and then at the first step P-1, the injection signal period $P_1$ for the first cylinder is set. Then, at the step P-2 injection is accomplished in the first cylinder which., due to the operation on the diesel cycle, then will initiate combustion.

The program then moves to the step P-3 to measure the time $T_1$ that cylinder 1 takes to reach top dead center from 30° before top dead center.

The program then moves to the step P-4 to set the injection signal period $P_3$ for cylinder number 3 and then at the step P-5 delivers fuel to the third cylinder by operating its injector 16 in the manner as aforedescribed. Then, at the step P-6, the time for the fourth cylinder to reach top dead center from 30° before top dead center is measured.

The program then continues through the steps P-7, P-8 and P-9 to set the injection signal $P_4$ for the fourth cylinder, inject the fourth cylinder and measure the time $T_4$ for the next firing cylinder (cylinder 2) to go from 30° before top dead center to top dead center. The program then repeats the same sequence for the remaining second cylinder and the steps P-10, P-11 and P-12. The program thus sets the injection period $P_2$ for the second cylinder, injects the second cylinder and measures the time $T_2$ for the first cylinder to travel from 30° before top dead center to top dead center. Finally, at the step P-13 the program measures the mean time $T_a$ of the times $T_1$, $T_2$, $T_3$ and $T_4$.

Figure 8:
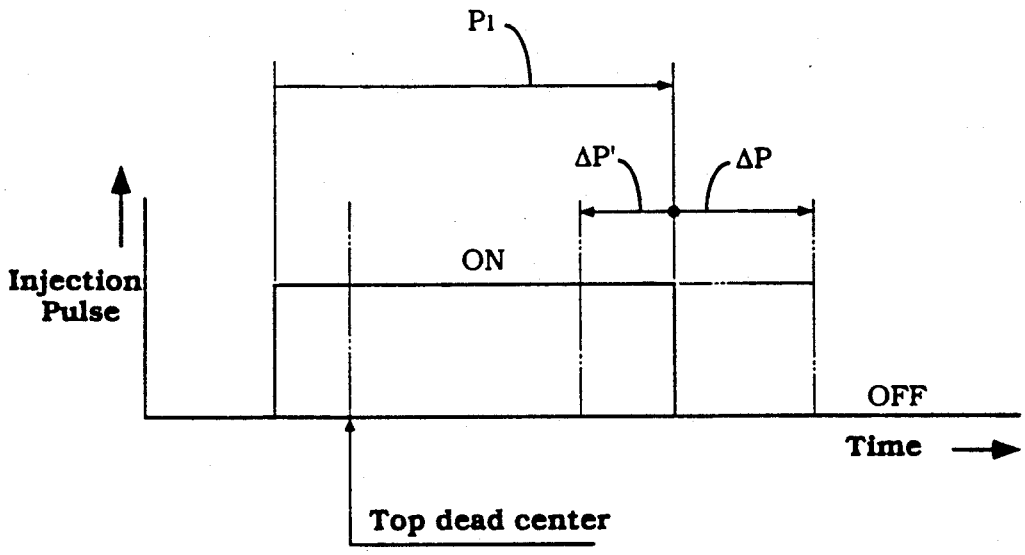
FIG. 8 is a graphic view showing the timing of the fuel injection pulse relative to crankshaft angle in accordance with the invention.
Figure 9:
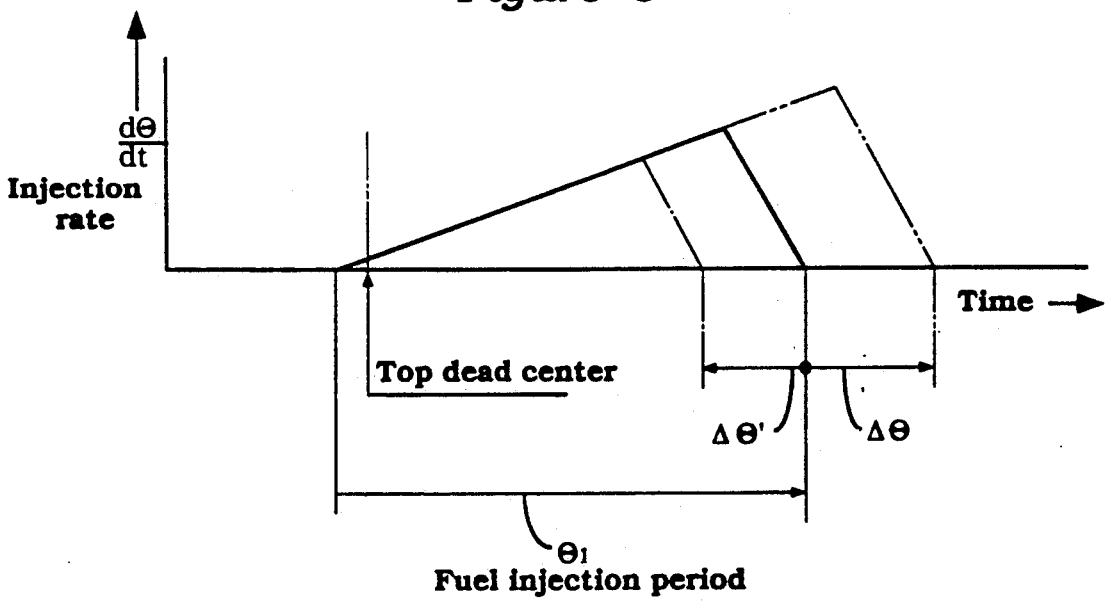
FIG. 9 is a graphic view showing the delivery of fuel in relation to crankshaft angle in accordance with an embodiment of the invention.

FIGS. 8 and 9 show respectively the period of deenergization of the individual solenoids 57 of the fuel injectors 16 and the amount of fuel injected. Typically, the injection signal period $P_1$ for cylinder 1 is depicted and the signals for the remaining cylinders would be the same. The fuel injection period is shown in FIG. 9 at $\theta$ and the injection rate dQ/dt is also shown in this figure. It can be seen that the amount of fuel injected can be varied by changing the injection period either by shortening it by the amount $\Delta P'$ or lengthening it by the amount $\Delta P$ which will cause a decreased $\Delta \theta'$ or an increased $\Delta \theta$ in the injection period. The program determines what the amount of variation and injection time and amount of fuel delivered should be. In the present embodiment, the amount of fuel injected is varied by changing the time when the solenoid 57 is reactivated or the end of injection. Of course, the amount of fuel injected can be varied by changing the time of initiation of injection or, alternatively, both beginning and end of injection timing can be varied to achieve engine speed stability.

Figure 7:
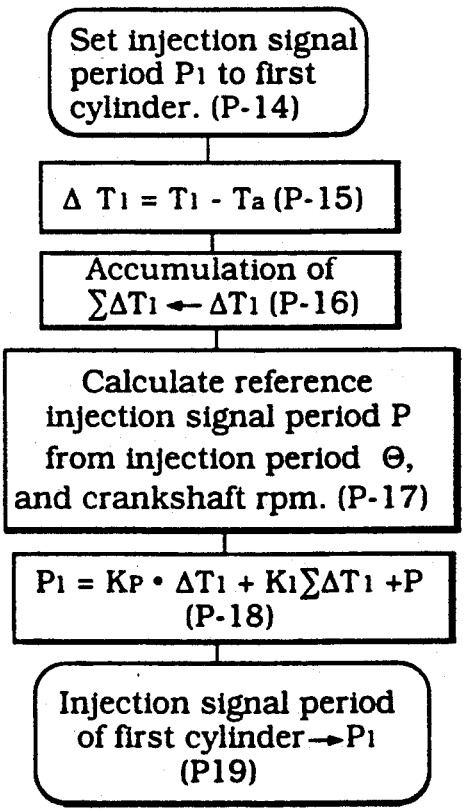
FIG. 7 is a further block diagram showing another portion of the control routine.

Referring now to FIG. 7, the program continues from the step P-13 to the step P-14 to set an injection signal period for the first cylinder $P_1$ which is based upon only the engine running parameters and makes no adjustment for variations in running conditions from cylinder to cylinder. Then the difference $\Delta T_1$ between the retired time $T_1$ and the average $T_a$ calculated at the step P-13 is calculated at the step P-15. Then at the step P-17, the input from the personal computer 72 calculates a reference injection period from the engine running parameters. The program then moves to the step P-18 to make an adjustment in this based upon the data calculated in accordance with the following equation:

$$P_1 = K_p \cdot \Delta T_1 + K_1 \Sigma \Delta T_1 + P$$

wherein $K_p$ = proportional coefficient $K_1$ = integral coefficient.

By setting the coefficients smaller, the setting of $P_1$ will be changed gradually and by setting the coefficients larger, the setting of $P_1$ will be changed abruptly. A gradual change will cause the speed to stabilize more slowly, but will effect less hunting, while a more rapid speed change will effect more hunting variation. The coefficients are set by certain outside parameters such as may be made smaller when the ambient air is warm and larger when the ambient air is cold. The program then transfers this calculation at the step P-19 to the controls so as to set the new value for the step P-1. The same adjustments are then made for each of the successive cylinders.

Figure 10:
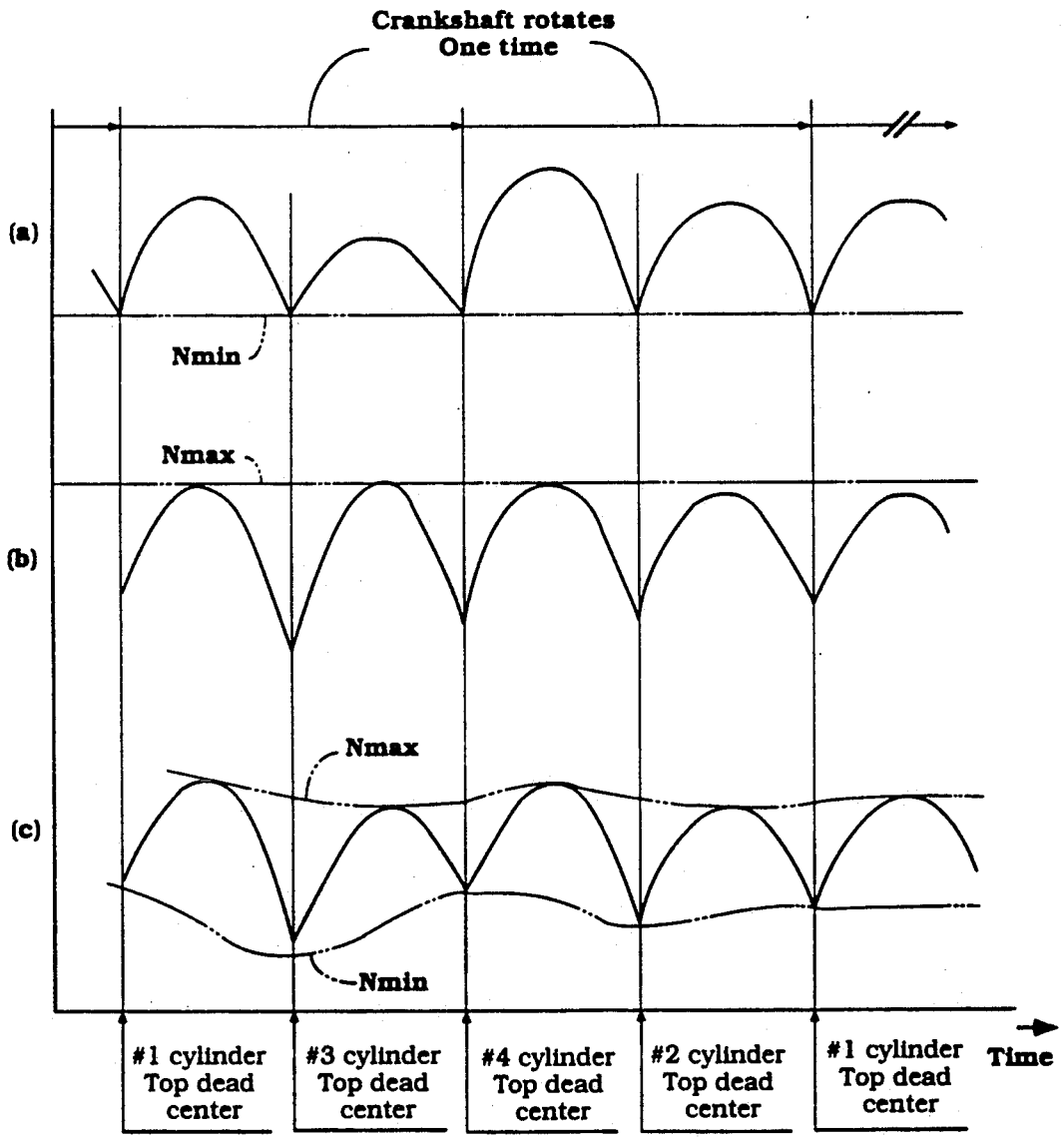
FIGS. 10, *a–c* are graphic views showing the speed variations of the crankshaft during a revolution in accordance with three different embodiments of the invention, each identified by the respective curve a, b and c.

The curve a in FIG. 10 shows the effect of minimizing the variations in engine speed during the successive rotation of the crankshaft as the respective cylinder is fired. It can be seen that this substantially improves cylinder to cylinder variation from the unadjusted engine as seen in FIG. 5.

Curve b shows another control routine which is basically the same, but the time period at which the speed variation is measured is different. In this embodiment, the retired times $T_1$, $T_2T_3$ and $T_4$ are measured close to bottom dead center and thus sense the maximum rotational speed for each cylinder. This can be measured from a certain number of degrees prior to bottom dead center until bottom dead center is reached. As may be seen in this curve, the speed variations also are minimized from those of the unadjusted engine of FIG. 5.

Curve c shows another control routine where the average rotational speed for each cylinder is controlled. This average can be determined from the calculation made at the step P-16.

It should be readily apparent from the foregoing description that the described embodiments of the invention are very effective in minimizing rotational speed differences of the crankshaft as each cylinder fires. Although a number of embodiments have been illustrated and described, various changes and modifications may be made without departing from the spirit and scope of the invention as defined by the appended claims.

We claim:

1. A fuel injection system for a multi cylinder engine comprising fuel injection means for delivering fuel directly into the cylinders of the engine, means for measuring the rotational speed of said engine in timed relation to the firing of each of said cylinders during the running of the engine, and means for adjusting said fuel injection means for minimizing variations in engine speed due to cylinder to cylinder variations.

2. A fuel injection system for a multi cylinder engine as set forth in claim 1 wherein the engine operates on a diesel cycle and combustion is initiated by a pressure increase in the combustion chamber.

3. A fuel injection system as set forth in claim 1 wherein the fuel injection means comprises an individual fuel injector for each cylinder.

4. A fuel injection system as set forth in claim 3 wherein the amount of fuel injected by the fuel injectors is adjusted to minimize speed variations.

5. A fuel injection system as set forth in claim 4 wherein the amount of fuel injected is varied by changing the duration of injection.

6. A fuel injection system as set forth in claim 1 wherein the rotational speed measured is the speed at top dead center.

7. A fuel injection system as set forth in claim 6 wherein the speed measured at top dead center is the time required to reach top dead center from a predetermined crank angle before top dead center.

8. A fuel injection system as set forth in claim 7 wherein the fuel injection means comprises an individual fuel injector for each cylinder.

9. A fuel injection system as set forth in claim 8 wherein the amount of fuel injected by the fuel injectors is adjusted to minimize speed variations.

10. A fuel injection system as set forth in claim 9 wherein the amount of fuel injected is varied by changing the duration of injection.

11. A fuel injection system as set forth in claim 1 wherein the rotational speed measured is measured at bottom dead center of the individual cylinders.

12. A fuel injection system as set forth in claim 11 wherein the bottom dead center speed is measured by determining the time to reach bottom dead center from a predetermined crank angle before bottom dead center.

13. A fuel injection system as set forth in claim 12 wherein the fuel injection means comprises an individual fuel injector for each cylinder.

14. A fuel injection system as set forth in claim 13 wherein the amount of fuel injected by the fuel injectors is adjusted to minimize speed variations.

15. A fuel injection system as set forth in claim 14 wherein the amount of fuel injected is varied by changing the duration of injection.

16. A fuel injection system as set forth in claim 1 wherein the rotational speed measured is the average rotational speed.

17. A fuel injection system as set forth in claim 16 wherein the average rotational speed is the average speed for each cylinder to travel a predetermined crank angle.

18. A fuel injection system as set forth in claim 17 wherein the fuel injection means comprises an individual fuel injector for each cylinder.

19. A fuel injection system as set forth in claim 18 wherein the amount of fuel injected by the fuel injectors is adjusted to minimize speed variations.

20. A fuel injection system as set forth in claim 19 wherein the amount of fuel injected is varied by changing the duration of injection.

21. A method of operating a fuel injection system for a multi cylinder engine comprising fuel injection means for delivering fuel directly into the cylinders of the engine, comprising the steps of measuring the rotational speed of said engine in timed relation to the firing of each of said cylinders during the running of the engine, and adjusting the fuel injection means for minimizing variations in engine speed due to cylinder to cylinder variations.

22. A method as set forth in claim 21 wherein the engine operates on a diesel cycle and combustion is initiated by the pressure in the combustion chamber.

23. A method as set forth in claim 21 wherein the fuel injection means comprises an individual fuel injector for each cylinder.

24. A method as set forth in claim 23 wherein the amount of fuel injected by the fuel injectors is adjusted to minimize speed variations.

25. A method as set forth in claim 24 wherein the amount of fuel injected is varied by changing the duration of injection.

26. A method as set forth in claim 21 wherein the rotational speed measured is the speed at top dead center.

27. A method as set forth in claim 26 wherein the speed measured at top dead center is the time required to reach top dead center from a predetermined crank angle before top dead center.

28. A method as set forth in claim 27 wherein the fuel injection means comprises an individual fuel injector for each cylinder.

29. A method as set forth in claim 28 wherein the amount of fuel injected by the fuel injectors is adjusted to minimize speed variations.

30. A method as set forth in claim 29 wherein the amount of fuel injected is varied by changing the duration of injection.

31. A method as set forth in claim 21 wherein the rotational speed measured is measured at bottom dead center of the individual cylinders.

32. A method as set forth in claim 31 wherein the bottom dead center speed is measured by determining the time to reach bottom dead center from a predetermined crank angle before bottom dead center.

33. A method as set forth in claim 32 wherein the fuel injection means comprises an individual fuel injector for each cylinder.

34. A method as set forth in claim 33 wherein the amount of fuel injected by the fuel injectors is adjusted to minimize speed variations.

35. A method as set forth in claim 34 wherein the amount of fuel injected is varied by changing the duration of injection.

36. A method as set forth in claim 21 wherein the rotational speed measured is the average rotational speed.

37. A method as set forth in claim 36 wherein the average rotational speed is the average speed for each cylinder to travel a predetermined crank angle.

38. A method as set forth in claim 37 wherein the fuel injection means comprises an individual fuel injector for each cylinder.

39. A method as set forth in claim 38 wherein the amount of fuel injected by the fuel injectors is adjusted to minimize speed variations.

40. A method as set forth in claim 34 wherein the amount of fuel injected is varied by changing the duration of injection.

* * * * *

UNITED STATES PATENT AND TRADEMARK OFFICE

CERTIFICATE OF CORRECTION

PATENT NO. : 5,117,793

DATED : June 2, 1992

INVENTOR(S) : Taue, et al

It is certified that error appears in the above-identified patent and that said Letters Patent is hereby corrected as shown below:

Column 8, line 60, Claim 40, "34" insert --39--.

Signed and Sealed this

Twenty-eighth Day of September, 1993

Bruce Lehman

*Attest:*

BRUCE LEHMAN

*Attesting Officer*

*Commissioner of Patents and Trademarks*